US008764158B2

(12) United States Patent
Asai et al.

(10) Patent No.: US 8,764,158 B2
(45) Date of Patent: Jul. 1, 2014

(54) FEEDING APPARATUS AND RECORDING APPARATUS

(75) Inventors: Yasuyuki Asai, Tokyo (JP); Yuki Emoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 66 days.

(21) Appl. No.: 13/380,257

(22) PCT Filed: Jun. 28, 2010

(86) PCT No.: PCT/JP2010/004273

§ 371 (c)(1),
(2), (4) Date: Dec. 22, 2011

(87) PCT Pub. No.: WO2011/001660

PCT Pub. Date: Jan. 6, 2011

(65) Prior Publication Data

US 2012/0105536 A1 May 3, 2012

(30) Foreign Application Priority Data

Jun. 30, 2009 (JP) ..... 2009-155677

(51) Int. Cl.
*B41J 2/015* (2006.01)

(52) U.S. Cl.
USPC ..... 347/20

(58) Field of Classification Search
USPC ..... 347/20
See application file for complete search history.

(56) References Cited

U.S. PATENT DOCUMENTS 5,648,807 A * 7/1997 Saito et al. ..... 347/102
5,695,182 A * 12/1997 Sekine ..... 271/9.09
6,953,190 B2 * 10/2005 Shin ..... 271/170

FOREIGN PATENT DOCUMENTS

| | | | |
|---|---|---|---|
| EP | 2017203 | A2 | 1/2009 |
| JP | 8-020446 | A | 1/1996 |
| JP | 8-208042 | A | 8/1996 |
| JP | 2002-154670 | A | 5/2002 |
| JP | 2004-269124 | A | 9/2004 |
| JP | 4006432 | B2 | 11/2007 |

* cited by examiner

*Primary Examiner* — Alessandro Amari
*Assistant Examiner* — Michael Konczal
(74) *Attorney, Agent, or Firm* — Canon USA Inc IP Division

(57) ABSTRACT

A feeding apparatus includes a pressing plate movable up and down configured to allow recording media to be stacked thereon, a feeding roller configured to feed recording media stacked on the pressing plate, an urging unit configured to urge the pressing plate in a direction to come close to the feeding roller, and a moving-away unit configured to cause the pressing plate to move away from the feeding roller against an urging force from the urging unit. The moving-away unit causes the pressing plate to move so that a distance between the uppermost recording medium being stacked and the feeding roller becomes approximately constant regardless of an amount of recording media stacked on the pressing plate.

13 Claims, 12 Drawing Sheets

FEEDING APPARATUS AND RECORDING APPARATUS

TECHNICAL FIELD

The present invention relates to a feeding apparatus and a recording apparatus for feeding sheet materials or sheet paper, such as recording materials, copying materials, or originals, while separating them one by one to a print recording unit, a copying unit, or a reading unit, in a recording apparatus, an image forming apparatus, or an image reading apparatus, such as a printer, a copying machine, a printing apparatus, a facsimile machine, or a scanner.

BACKGROUND ART

There are some conventional sheet cassettes wherein sheet feeding is performed to a recording unit of a recording apparatus while bringing the uppermost one of recording media stacked on a pressing plate into pressure contact with a sheet feeding roller. Of such sheet cassettes, some are configured such that the recording media are spaced apart from the sheet feeding roller by pressing down the pressing plate by a given amount against a press-contacting force during a sheet feeding operation (see Japanese Patent No. 4006432).

Further, there are some sheet cassettes which have an elevation mechanism for moving a pressing plate toward a sheet feeding roller by generating an urging force in the process of mounting the sheet cassette into a main body. The elevation mechanism includes the pressing plate rotatably provided within the sheet cassette, a spring operably coupled to a free end of the pressing plate, and an elevating arm for pulling up the other end of the spring. In the main body, a guide for guiding the elevating arm is formed. In the process of mounting the sheet cassette into the main body, the guide pulls up the elevating arm, and the spring operably coupled to the elevating arm pulls up the pressing plate (see Japanese Patent Application Laid-Open No. 2002-154670).

Moreover, a mechanism for providing an opening for inserting paper sheets in the vicinity of a mounting port of the sheet cassette and feeding the sheets inserted into the opening using a separation/feeding mechanism of the sheet cassette is discussed in Japanese Patent Application Laid-Open No. 2004-269124. In this mechanism, a leading edge of the sheet inserted from the opening portion is guided toward a clearance between the sheets stacked in the sheet cassette and the sheet feeding roller.

However, in the sheet cassette discussed in Patent No. 4006432, the pressing plate is released by a given amount during a feeding operation, but there is no description whether the uppermost sheet of the recording media on the pressing plate is spaced apart from the sheet feeding roller at the time when mounting of the sheet cassette is completed. In addition, in the feeding apparatus discussed in Japanese Patent Application Laid-Open No. 2002-154670, there is a problem in that, because the recording medium on the pressing plate comes into press-contact with the sheet feeding roller at the time when mounting of the sheet cassette is completed, it is difficult to arrange a manual feed unit for manual sheet feeding on the top of the pressing plate using the same sheet feeding roller.

In the sheet feeding apparatus discussed in Japanese Patent Application Laid-Open No. 2004-269124, the manual feed unit for performing manual sheet feeding is arranged on the top of the pressing plate using the same sheet feeding roller, and the pressing plate is spaced apart from the sheet feeding roller by full-stroke. In the feeding apparatus discussed in Japanese Patent Application Laid-Open No. 2004-269124, however, a driving load becomes large in order to deal with a large capacity sheet feeding, because the pressing plate is spaced apart from the sheet feeding roller by full-stroke against press-contacting force necessary for sheet feeding.

SUMMARY OF INVENTION

The present invention is directed to a feeding apparatus capable of forming a clearance between stacked recording media and a feeding roller at the time when a feeding operation is completed, without the need to increase a drive load.

According to an aspect of the present invention, a feeding apparatus includes a pressing plate movable up and down configured to allow recording media to be stacked thereon, a feeding roller configured to feed recording media stacked on the pressing plate, an urging unit configured to urge the pressing plate in a direction to come close to the feeding roller, and a moving-away unit configured to cause the pressing plate to move away from the feeding roller against an urging force from the urging unit, wherein the moving-away unit causes the pressing plate to move so that a distance between the uppermost recording medium being stacked and the feeding roller becomes approximately constant regardless of an amount of recording media stacked on the pressing plate.

According to an exemplary embodiment of the present invention, a feeding apparatus can be provided, wherein a clearance between stacked recording media and the feeding roller is formed at the time when feeding operation is completed, without the need to increase a drive load. In particular, the drive load can be reduced in the feeding apparatus wherein a large amount of recording media can be stacked.

Further features and aspects of the present invention will become apparent from the following detailed description of exemplary embodiments with reference to the attached drawings.

BRIEF DESCRIPTION OF DRAWINGS

The accompanying drawings, which are incorporated in and constitute a part of the specification, illustrate exemplary embodiments, features, and aspects of the invention and, together with the description, serve to explain the principles of the invention.

DESCRIPTION OF EMBODIMENTS

Figure 1:
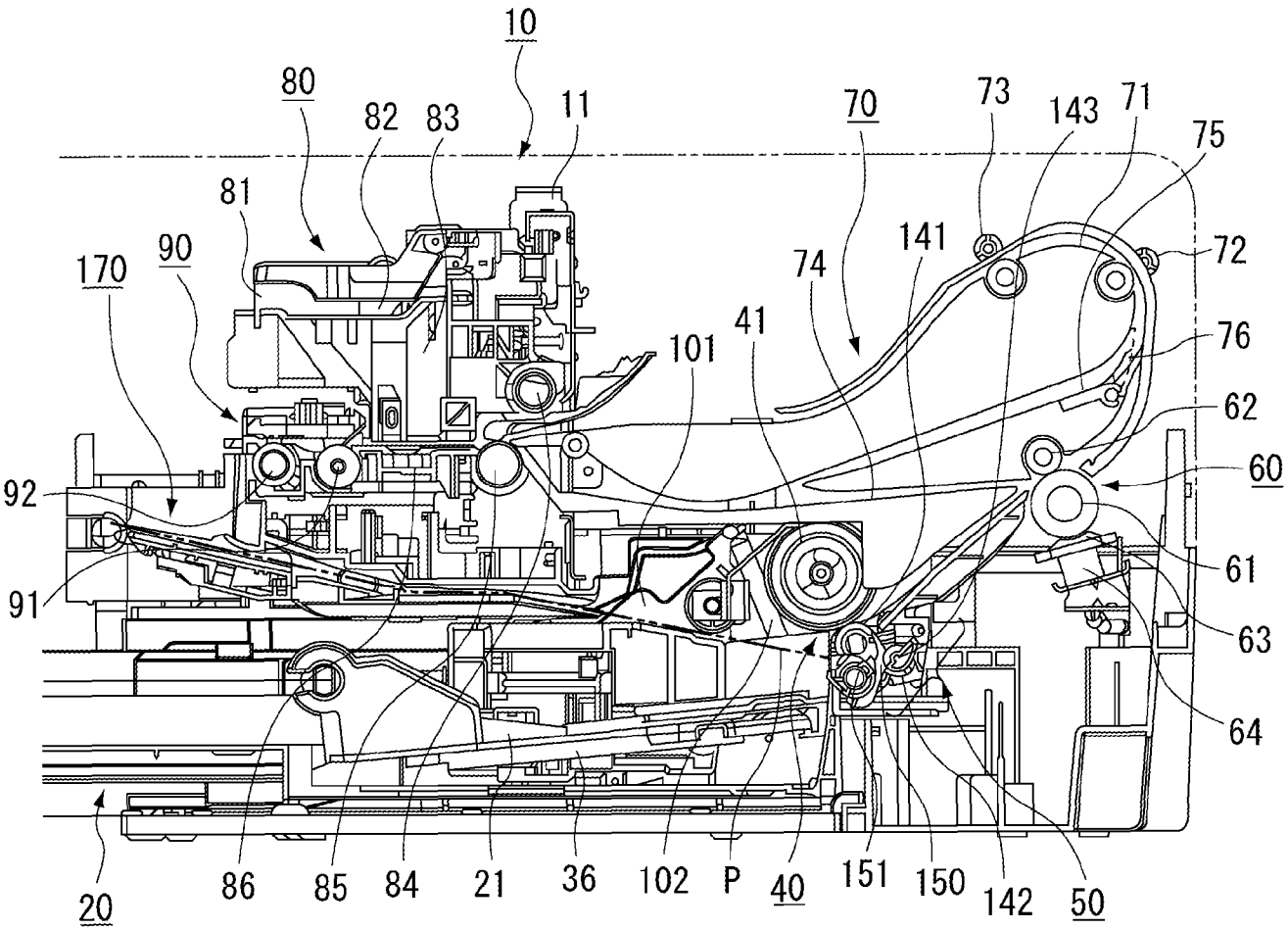
FIG. 1 is a partial sectional view of a recording apparatus having a sheet feeding apparatus according to an exemplary embodiment of the present invention.

Various exemplary embodiments, features, and aspects of the invention will be described in detail below with reference to the drawings.

First, a recording apparatus having a sheet feeding apparatus according to an exemplary embodiment of the present invention will be described with reference to FIGS. 1 and 2.

A recording apparatus 10 includes a pickup unit 40 for picking up a plurality of pieces of recording media P from a sheet cassette 20 and a manual feed unit 170, and a separation section 50 for separating a plurality of pieces of picked-up recording media P one by one. Moreover, the recording apparatus includes a coating unit 60 for coating reactive liquid, which reacts with ink, in advance of a recording operation on separated recording medium P, and a conveyance unit 70 for conveying the recording medium P to a recording position. Images are recorded by a recording unit 80 on the recording medium P conveyed to the recording position, and the recording medium P, on which recording of the images is completed, is discharged by a sheet discharge unit 90 to the outside of the recording apparatus 10.

An elevation mechanism of the pickup unit 40 will be described. A pressing plate 21 capable of stacking a plurality of pieces of the recording media P thereon is rotatably provided in the sheet cassette 20. The sheet cassette 20 is provided with an arm 101. One end of the arm 101 is rotatably supported by the sheet cassette 20, and the other end is operably coupled with the pressing plate 21 and a pressing plate spring 102. The sheet cassette 20 is provided with a first sector gear 111 as a first engagement member pivotable around a shaft 111*a* in operative association with the pressing plate 21. The first sector gear 111 has a plurality of teeth as an engagement portion along a moving direction thereof. The sheet cassette 20 is provided with a second sector gear 112 engageable with the first sector gear as a second engagement member. A second sector gear 112 is pivotally supported around a shaft 113*a* by the sheet cassette 20 via a sector gear holder 113.

The recording apparatus 10 is provided with a lever 121 as a third engagement member engageable with the second sector gear 112 via the sector gear holder 113. The lever 121 is pivotally supported around a shaft 121*b* by the conveyance unit 70, and is brought into press-contact with a cam 131*a*, which rotates integrally with a cam gear 131, by a lever spring 122.

Figure 2:
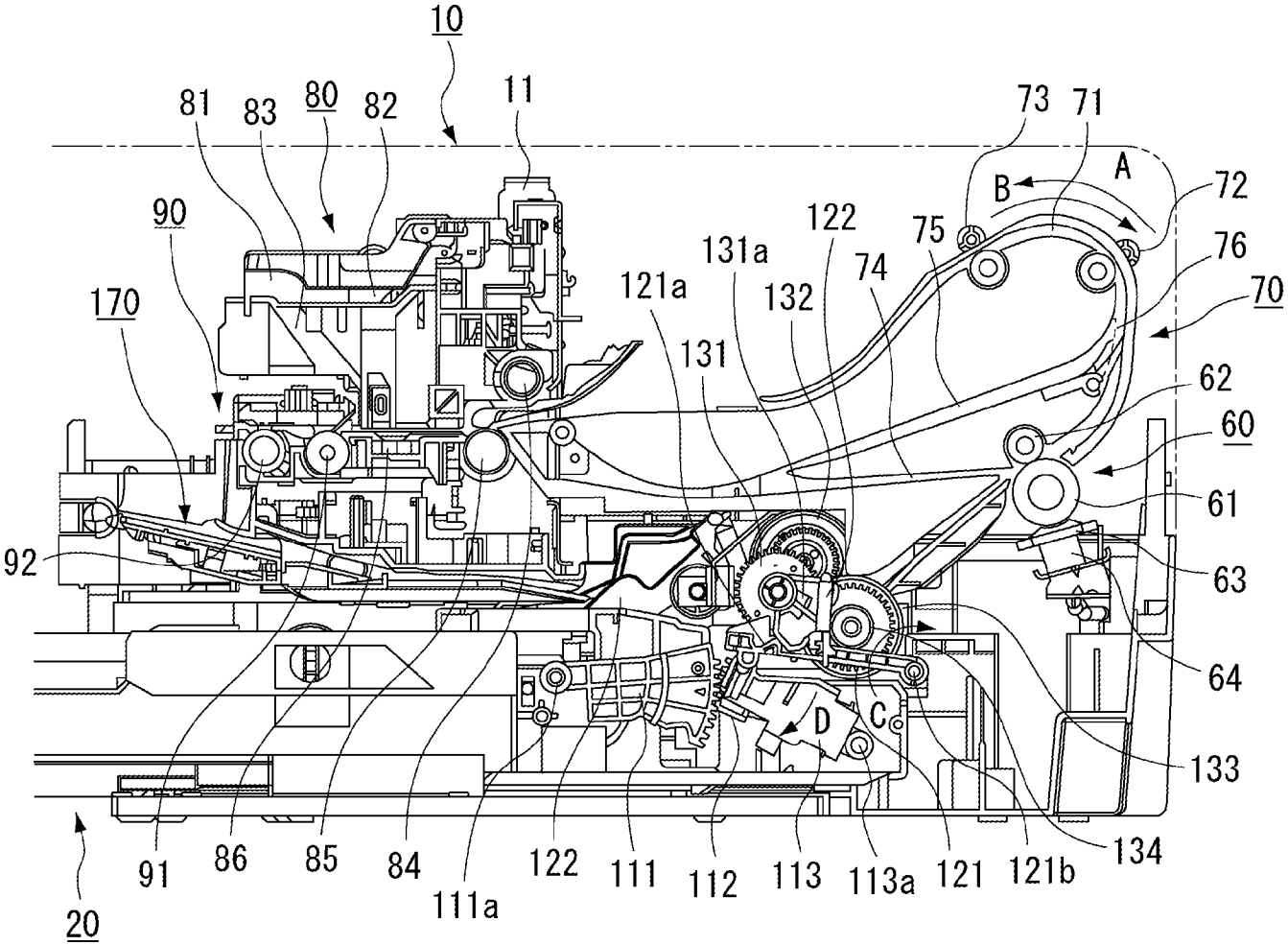
FIG. 2 illustrates a sheet feeding operation of the sheet feeding apparatus.

In a state in which mounting of the sheet cassette is completed in FIG. 1 and FIG. 2, an urging force in a direction of the sheet feeding roller 41 by the pressing plate spring 102 acts on the pressing plate 21. The cam 131*a* formed in gear widthwise direction of the cam gear 131 and a cam follower portion 121*a* formed in the lever 121 engage with each other, to control pivoting of the lever 121. During a picking-up operation, the sheet feeding roller 41 comes into contact with the recording medium P on the pressing plate 21, which is elevated in operative association with pivoting action of the lever 121, and feeds the recording medium P to the separation section 50. The sheet feeding roller 41 is rotatably supported by the conveyance unit 70, and the sheet feeding roller 41 is provided with a sheet feeding roller gear 132, which rotates coaxially in the same direction.

The separation section 50 will be described. The separation section 50 is provided with a separation roller 141 having a high friction material such as rubber on an outer peripheral surface of a torque limiter having no drive source as a separation unit, and a return claw 150. The separation roller 141 is supported by the conveyance unit 70 via a separation roller holder 142 so that it can move so as to be able to come into or out of contact with the sheet feeding roller 41. Further, the separation roller holder 142 and the conveyance unit 70 are interconnected by a separation roller spring (not illustrated), so that an urging force acts in the direction of the sheet feeding roller 41.

The return claw 150 is a claw portion formed in a radius direction at a pivotal center from a shaft portion pivotally supported by the conveyance unit 70, and a plurality of return claws 150 are provided in a direction intersecting with a conveying direction of the recording medium P. The return claw 150 and the conveyance unit 70 are operably coupled to each other by a return claw spring (not illustrated), and an urging force is exerted so that the return claw 150 rotates in the conveying direction. Further, the conveyance unit 70 is provided with a control cam gear 133 for controlling movement of the separation roller holder 142 and rotation of the return claw 150. The cam portion (not illustrated) in gear widthwise direction of the control cam gear 133 and the separation roller holder 142 engage with each other via the release lever 143, and the return claw 150 engages therewith via the cam follower portion 121*a* integrally molded with a return claw bearing 151. Other separation scheme such as Duplo or a torque limiter having a drive source may be used for the separation unit.

The coating unit 60 will be described. The coating unit 60 is provided with a coating roller 61 for coating reactive liquid for causing the recording medium P to react with ink in advance of a recording operation and enhancing image quality such as coloring property, and a counter roller 62 paired with the coating roller 61. The coating roller 61 and the counter roller 62 are rotatably supported by the conveyance unit 70. Further, a cap portion 63 for supplying the reactive liquid is brought into press-contact with the coating roller 61 by a cap spring 64. The coating unit 60 is configured such that the reactive liquid is circulated by a pump (not illustrated) from a tank (not illustrated) into the cap portion 63, and the reactive liquid spreads over the whole peripheral surface of the coating roller 61 as the coating roller 61 rotates.

The conveyance unit 70 will be described. The conveyance unit 70 is mounted on the main frame 11, and is provided with a conveyance path 71 through which the recording medium P is conveyed to the recording unit 80 via a U-turn path, and two conveyance roller pairs 72 and 73. In addition, the conveyance unit 70 is provided with a reversing conveyance path 74 for drawing the recording medium P, which has passed through the recording unit 80, so as to reverse the both sides of the recording medium P and re-feed it to the recording unit 80. The conveyance unit 70 is provided with a switchback conveyance path 75, which is to be branched to the inner side of U-turn path, so that the recording medium P may not pass through the coating unit 60, when conveying the recording medium P in a forward direction (arrow A in FIG. 2) toward the recording unit 80 and causing it to pass through the coating unit 60, and after that, conveying it in an opposite direction (arrow B). A flapper 76 is rotatably supported by the conveyance unit 70 for causing the recording medium P to branch to the switchback conveyance path 75.

The recording unit 80 will be described. The recording unit 80 includes an ink tank 81, a head 82, which is a recording unit for discharging ink from the ink tank 81 toward the recording medium P according to recording information, and a carriage 83 for mounting attachably/detachably the ink tank 81 and the head 82. The head 82 is provided with a plurality of nozzles, and adopts an inkjet method for discharging ink from each nozzle toward the recording medium according to recording information. A platen 86 for conveying the recording medium P in the ink discharge direction of the carriage 83 is attached on the main frame 11. The carriage 83 is attached to the main frame 11 via a guide shaft 84, and is movable in the direction intersecting with the conveyance direction of the recording medium P. An intermittent roller pair 85 for causing the recording medium P to intermittently move to a recording position is rotatably attached to the main frame 11.

The sheet discharge unit 90 will be described. The sheet discharge unit 90 is provided with two sheet discharge roller pairs 91 and 92 for discharging the recording medium P on which recording is completed by the recording unit 80 to the outside of the recording apparatus 10, and is rotatably supported by the main frame 11.

A drive of the pickup unit 40 and the separation section 50 will be described. A drive from a motor (not illustrated) is arranged to transmit drive to a control cam gear 133 and a sheet feeding roller gear 132, and to the cam gear 131 via an idler gear 134. In an initial state, the pressing plate 21 is spaced apart from the sheet feeding roller 41, the separation roller 141 comes into press-contact therewith, and a return claw 150 is located at a position to block the conveyance path. In this state, when the drive is transmitted to the idler gear 134, the idler gear 134 rotates in the arrow direction (clockwise direction) in FIG. 2, and the sheet feeding roller 41 also begins to rotate, so that the drive is transmitted to the separation roller 141, which thereby rotates together.

Subsequently, since the drive of the idler gear 134 is also transmitted to the cam gear 131, the cam 131*a* rotates, and the lever 121 turns in the arrow C direction in FIG. 2. The pressing plate 21 is prevented from turning by a second sector gear 112, which is prevented from turning by the lever 121, and a first sector gear 111, which meshes therewith. When the lever 121 turns in the arrow C direction, the second sector gear 112 and the first sector gear 111 become to be able to turn by the same amount, and the pressing plate 21 is elevated by the urging force of the pressing plate spring 102. Then, the recording media P stacked on the pressing plate 21 come into press-contact with the sheet feeding roller 41.

The sheet feeding roller 41 picks up the recording medium P. Then, the sheet feeding roller 41 feeds a plurality of sheets of the recording media P to the separation section 50, and the separation section separates them one by one. At this time, the return claw 150 turns to the conveyance direction side, and is controlled to retract from the conveyance path. The separated recording medium P is fed toward the coating unit 60.

After the sheet feeding roller 41 has rotated by a predetermined rotation amount, the cam 131*a* of the cam gear 131 depresses the lever 121, and causes the second sector gear 112 to turn in a counterclockwise direction via the sector gear holder 113 at the sheet cassette 20 side. The first sector gear 111, which meshes with the second sector gear 112, turns in a clockwise direction, and causes the pressing plate 21, which synchronously rotates with a shaft 111*a*, to move away from the sheet feeding roller 41. The recording medium P left in the separation section 50 is returned to the pressing plate 21 by causing the return claw 150 to turn again into the conveyance path. The return claw 150 comes into contact with the recording medium P left in the separation section 50, and the separation roller 141 is controlled to move away from the sheet feeding roller 41. Then, the separation roller 141 returns to the initial state. The control is configured to be performed in one rotation of the control cam gear 133.

Next, the configuration of the sheet cassette 20 according to the exemplary embodiment of the present invention will be described.

Figure 3:
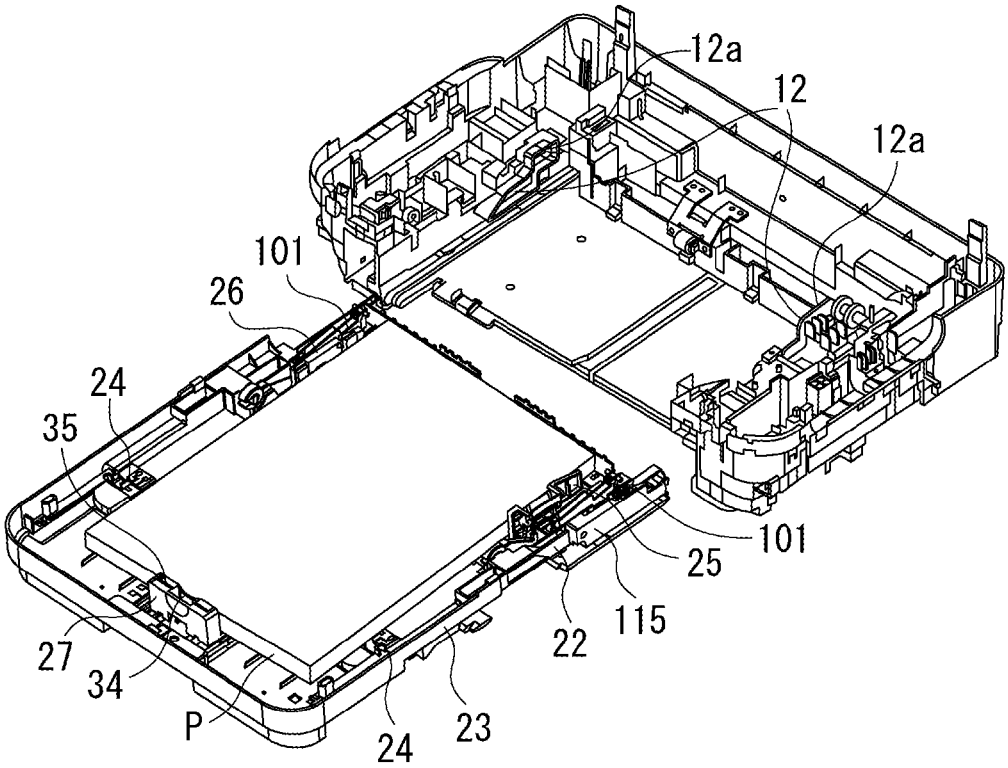
FIG. 3 is a perspective view of the sheet feeding apparatus while a sheet cassette is not mounted.
Figure 4:
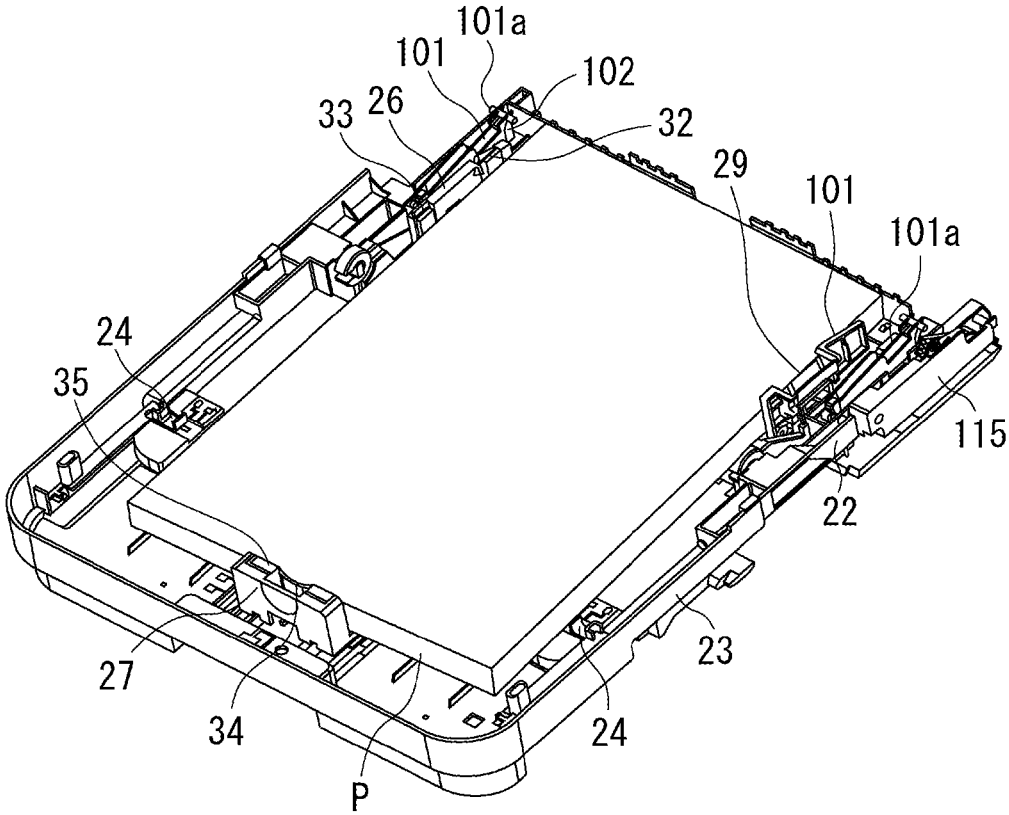
FIG. 4 is a perspective view of the sheet cassette, which has stacked recording media.
Figure 5:
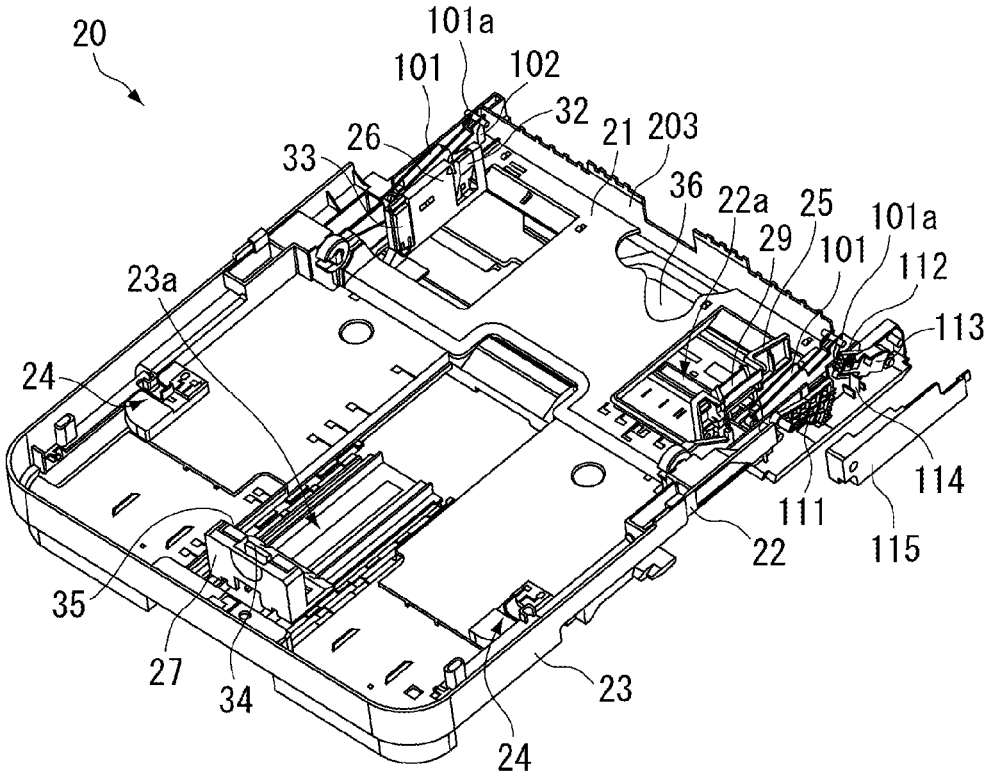
FIG. 5 is a perspective view of the sheet cassette, which has not yet stacked recording media.

FIG. 3 is perspective view illustrating the sheet feeding apparatus and the recording apparatus according to the exemplary embodiment of the present invention. FIG. 4 and FIG. 5 are perspective views illustrating the sheet feeding apparatus according to the exemplary embodiment of the present invention. The sheet cassette 20 mountable on the apparatus main body is provided with an inner cassette 22, and an outer cassette 23. The inner cassette 22 and the outer cassette 23 are configured to be extensible, and extensible positions can be fixed by two lock members 24. Within the inner cassette 22, there is provided the pressing plate 21 with the recording media P being stacked thereon is movable vertically upward and downward. The inner cassette 22 is provided with a first side guide 25 for regulating a direction perpendicular to the conveyance direction of the recording medium P, a second side guide 26, and an end guide 27 for regulating an opposed side to the separation section 50 of the recording medium P. Then, the pressing plate 21 is rotatably supported within the inner cassette 22. The first side guide 25 is provided with a side guide lever 29 and a side guide latch (not illustrated). The side guide lever 29 is rotatably supported by the first side guide 25. The side guide latch (not illustrated) is configured to operate in association with the side guide lever 29, and an urging force is exerted by a side guide latch spring (not illustrated) in a direction in which the side guide latch always engages with an inner cassette latch portion 22*a*. It is only necessary to move the two side guides to a position suitable for a size of the recording medium P, by operating the side guide lever 29, and to cause the side guide latch (not illustrated) to engage with the inner cassette latch portion 22*a*. At this time, the second side guide 26 also moves at the same time via the side guide gear (not illustrated).

The second side guide 26 is provided with a first urging plate 32 and a second urging plate 33 through which an urging force is exerted to the recording media P side by a spring (not illustrated). The two urging plates each are set to come into contact with the recording media P with an appropriate pressure.

The end guide 27 is provided with an end guide lever 34 and an end guide plate 35. The end guide lever 34 is rotatably supported by the end guide 27, and an urging force is exerted by a spring (not illustrated) to turn the end guide lever 34 in a direction in which the end guide 27 always engages with an outer cassette latch portion 23*a*. Moreover, the end guide plate 35 is rotatably supported by the end guide 27, and an urging force is exerted by the spring (not illustrated) to turn the end guide plate 35 in a direction of the separation section 50.

The inner cassette 22 is provided with the above-described two arms 101, and has a projection portion 101*a*, which projects to the outside of the inner cassette 22. The projection portion 101*a* is provided on the side where the pressing plate spring 102 of the arms 101 is attached. Moreover, the inner cassette 22 is provided with a release plate 36, the above-described first sector gear 111 and second sector gear 112 paired with the first sector gear 111, and a sector gear cover 115. The release plate 36 is configured to be supported by the inner cassette 22 around the same rotation center as that of the pressing plate 21, to engage with the pressing plate 21 at the center of the pressing plate 21 in a direction perpendicular to the recording medium conveyance direction, and at a position on the separation section 50 side, and to be rotatable integrally with the pressing plate 21. The first sector gear 111 is rotatably supported by one side of the inner cassette 22. Further, the first sector gear 111 can be operated in association with the release plate 36 by arranging an extension portion (not illustrated), which is situated at the release plate 36 side, on the release plate 36. The second sector gear 112 is also rotatably supported by the one side thereof so that it can engage with the first sector gear 111 via the above-described sector gear holder 113. Then, the second sector gear 112 is rotatably supported by the sector gear holder 113, and an urging force is exerted in an arrow D direction (FIG. 2) by a spring (not illustrated). Moreover, the urging force is exerted on the sector gear holder 113 by the sector gear holder spring 114 in a direction in which the second sector gear 112 moves away from the first sector gear 111.

An operation during sheet feeding of the sheet cassette 20 according to the exemplary embodiment of the present invention will be described.

Figure 6:
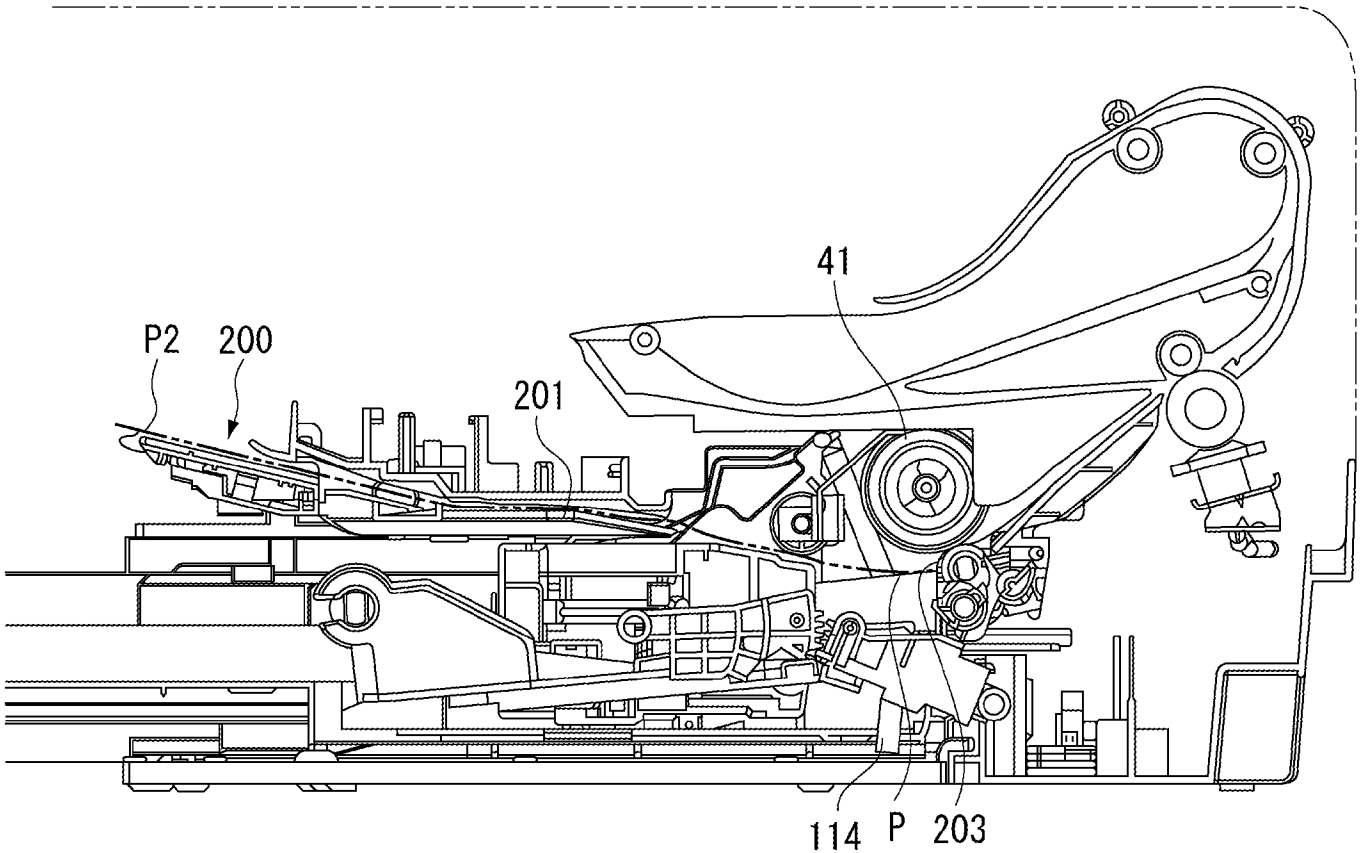
FIG. 6 is a sectional view of the sheet feeding apparatus it a standby state.
Figure 7A:
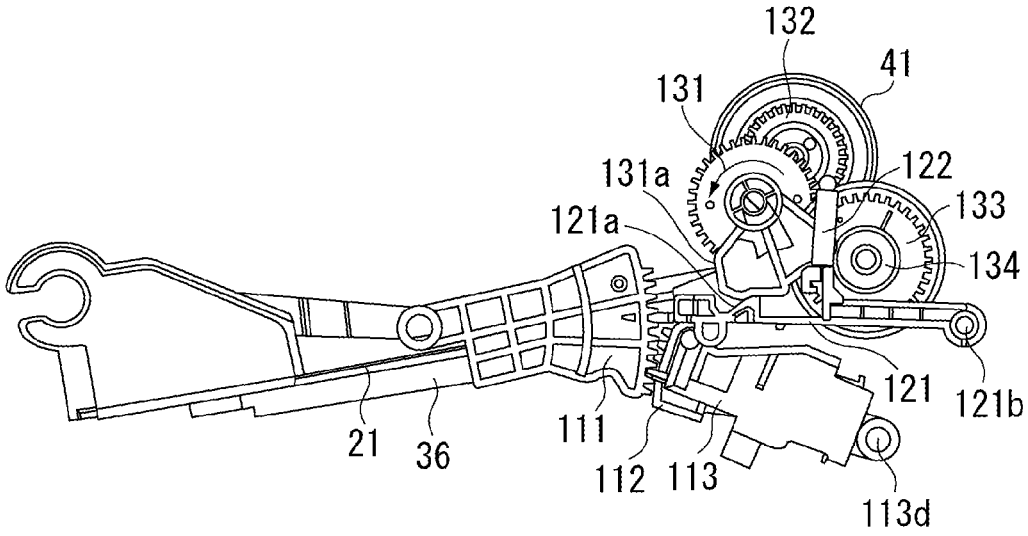
FIG. 7A is an operational explanatory view of sheet feeding from the sheet cassette.

FIG. 6 and FIG. 7A illustrate a standby state prior to the sheet feeding. The pressing plate 21 is spaced apart from the sheet feeding roller 41 against an urging force of the pressing plate spring 102. By the drive of the motor (not illustrated) in this state, the drive is transmitted to the control cam gear 133, the sheet feeding roller gear 132, and the cam gear 131 via the idler gear 134. The control cam gear 133 and the idler gear 134 rotate in the clockwise direction, and the sheet feeding roller gear 132 and the cam gear 131 rotate in the counterclockwise direction. The sheet feeding roller 41 also synchronously rotates with the sheet feeding roller gear 132.

Figure 7B:
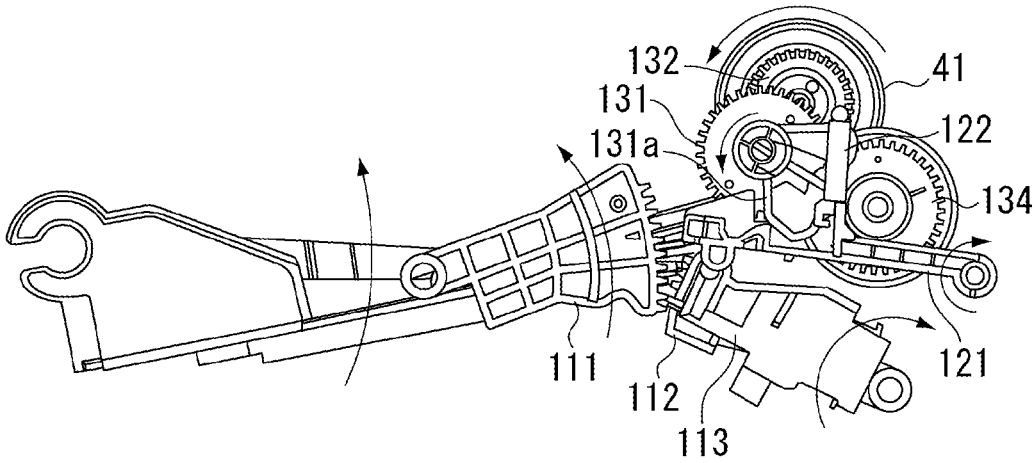
FIG. 7B is an operational explanatory view of sheet feeding from the sheet cassette.

When the cam gear 131 rotates in the counterclockwise direction in FIG. 7A, the cam 131*a* also rotates similarly, and engagement with the cam follower portion 121*a* of the lever 121 of the cam 131*a* is gradually disengaged as illustrated in FIG. 7B. As the cam 131*a* moves, the lever 121 pivots in the clockwise direction around the shaft 121*b*. The lever 121 comes into press-contact with the cam 131*a* of the cam gear 131 by the urging force of the lever spring 122.

In association with an action of the lever 121, and by an urging force of the sector gear holder spring 114, the second sector gear 112 rotates in the clockwise direction via the sector gear holder 113. At the same time, the first sector gear 111, which is in a mesh with the second sector gear 112, also rotates in the counterclockwise direction. At the same time, the release plate 36, which has been stopped to move by the mesh between the first sector gear 111 and the second sector gear 112, rotates toward the sheet feeding roller 41 in conjunction with the pressing plate 21 by the urging force of the pressing plate spring 102.

Figure 7C:
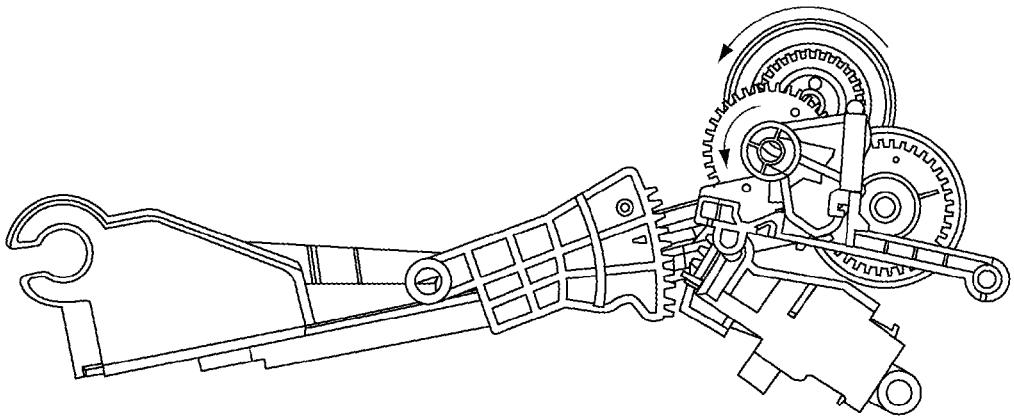
FIG. 7C is an operational explanatory view of sheet feeding from the sheet cassette.

If the first sector gear 111 and the second sector gear 112 are completely out of mesh with each other as illustrated in FIG. 7C, the uppermost sheet P1 of the recording media stacked on the pressing plate 21 comes into press-contact with the sheet feeding roller 41 by an urging force of the pressing plate spring 102, and the recording medium is then fed into the recording apparatus (FIG. 1). The first sector gear 111 is operated in association with the release plate 36, which is rotatable integrally with the pressing plate 21, and the operation is stopped by the uppermost sheet P1 of the recording media coming into press-contact with the sheet feeding roller 41. Moreover, the second sector gear 112 continues to rotate toward the cam gear 131 by the urging force of the sector gear spring 114 via the sector gear holder 113, and is kept latched by the lever 121 in a state where the second sector gear 112 is out of mesh with the first sector gear 111.

The sheet feeding operation is terminated when the cam gear 131 rotates one turn and returns to the position in FIG. 7A. The cam 131*a* rotating in the counterclockwise direction in the process abuts again against the cam follower portion 121*a* of the lever 121, and rotates the lever 121 in the counterclockwise direction. By the lever 121 rotating, the second sector gear 112 also meshes with the first sector gear 111 while rotating in the counterclockwise direction. From this state the second sector gear 112 causes the first sector gear 111 to rotate in the clockwise direction, and causes the pressing plate 21 via the release plate 36 to move by a given amount against the pressing plate spring 102, which returns to the state in FIG. 7A as the initial state. Therefore, the recording medium P1 on the pressing plate 21 becomes able to be always spaced apart from the sheet feeding roller 41 by a predetermined distance.

Since the recording medium is in contact with the sheet feeding roller 41, when the second sector gear 112 and the first sector gear 111 start to mesh with each other, the position of the first sector gear 111 is dependent on a stacking amount of the recording media. Further, the second sector gear 112 starts to mesh with the first sector gear 111 at approximately the same position each time. Approximately the same position means that even if the position of the first sector gear 111 differs a little, meshing teeth are the same, or if the position of the first sector gear 111 simply slightly differs, meshing teeth may deviate by one tooth or two teeth (hereinafter, referred to as meshing error).

The second sector gear 112 rotates by a predetermined amount during a time period since the second sector gear 112 has meshed with the first sector gear 111 until the cam 131 moves to the initial position (FIG. 7A), and a rotational angle beginning from the meshing is also constant if a rotation equivalent to the meshing error is removed. Therefore, a distance by which the pressing plate 21 is lowered from a position where to press down the recording medium onto the sheet feeding roller 41 is approximately constant, and an error of the lowered distance due to the meshing error of the sector gear is equal to or smaller than a pitch length of the first or second sector gear, or two times or less the pitch length at most.

with such a configuration, an approximately constant clearance can be formed between the sheet feeding roller 41 and the uppermost sheet P1 of the recording media, and a manual sheet feeding can be performed normally at the time of a sheet feeding operation. The need to lower the pressing plate 21 down to the lowest position each time against the pressing plate spring 102 is eliminated. As a result, a load of a driving system can be reduced, and an increased capacity of drive source such as a motor can be avoided.

Next, a mounting operation of the sheet feeding apparatus according to the exemplary embodiment of the present invention will be described.

Figure 8:
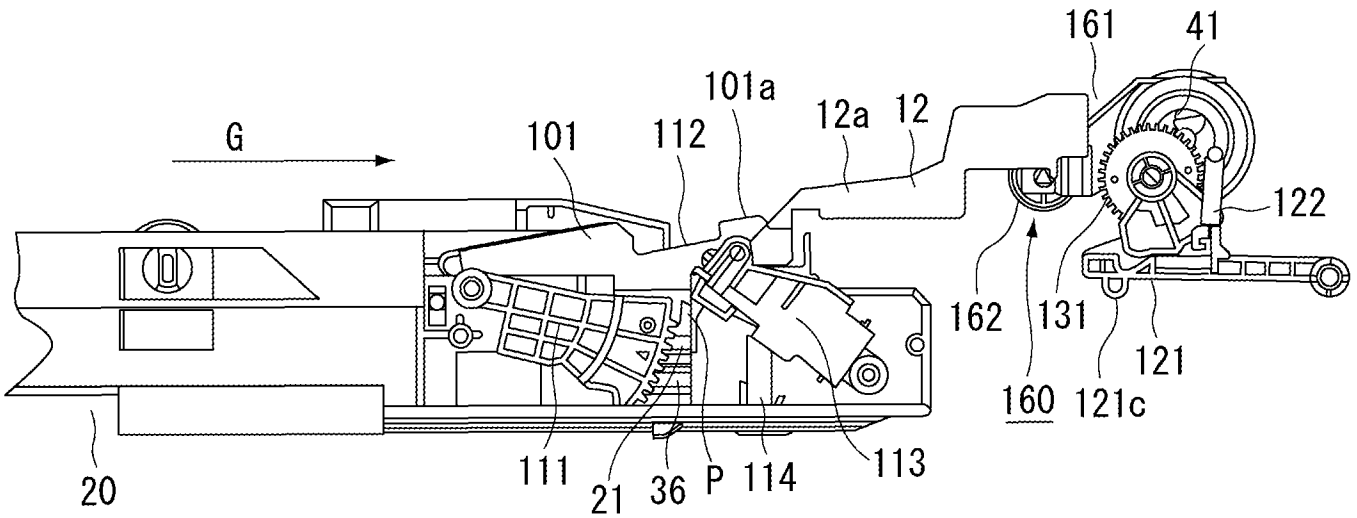
FIG. 8 illustrates the first half of a mounting process of the sheet feeding apparatus according to the exemplary embodiment of the present invention.
Figure 9:
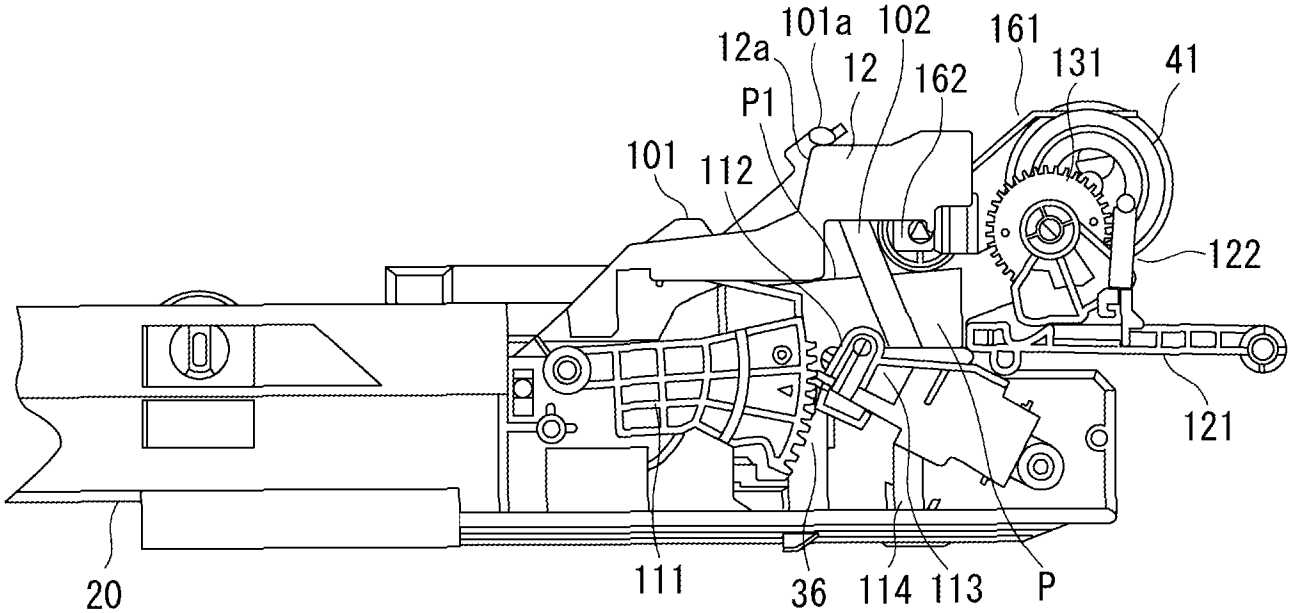
FIG. 9 illustrates the second half of the mounting process of the sheet feeding apparatus according to the exemplary embodiments of the present invention.
Figure 10:
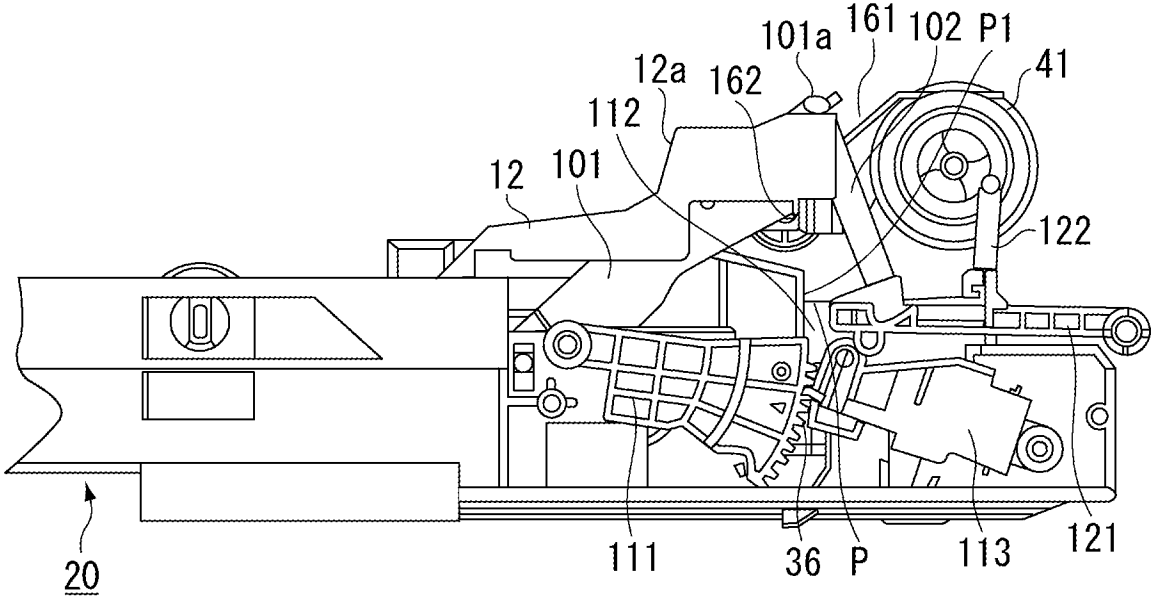
FIG. 10 illustrates a state in which mounting of the sheet feeding apparatus according to the exemplary embodiment of the present invention is completed.

As illustrated in FIG. 8 to FIG. 10, the sheet cassette 20, which has stacked the recording media P, is mounted in an arrow G direction as a mounting direction thereof. This direction coincides with the sheet feeding direction of the recording medium.

The recording apparatus 10 is provided with two guide members 12, which engage with the projection portion 101*a* of the arm portion 101 of the sheet cassette 20. The guide members 12 include guide surfaces 12*a* arranged on both sides of the sheet cassette 20 to be mounted. The recording apparatus 10 is provided with a regulation unit 160 for regulating the position of the uppermost sheet P1 of the recording media P on the pressing plate in the mounting process of the sheet cassette 20. As the regulation unit 160, the conveyance unit 70 is provided with a roller holder 161 and a roller member 162 as a rotating member. The roller member 162 is rotatably supported by the roller holder 161.

In the process of mounting the sheet cassette 20 into the recording apparatus as a mounting operation, the projection portion 101*a* of the aim portion 101 advancing in the arrow G direction in FIG. 8 is guided upward by the guide surface 12*a*, and the arm portion 101 pivots counterclockwise. The pivot of the arm portion 101 causes the pressing plate spring 102 operably connected to the arm portion 101 to generate an urging force, and the pressing plate 21 and the release plate 36 also pivot in a direction of the sheet feeding roller 41. Moreover, at this time the first sector gear 111 also pivots in operative association with the release plate 36. Then, as illustrated in FIG. 9, the roller member 162 comes into contact with the uppermost sheet P1 of the recording media on the pressing plate 21, which is elevating. At this time the uppermost sheet P1 reaches the same height as it comes into contact with the sheet feeding roller 41. Along with the elevation of the pressing plate 21, the first sector gear 111 pivots counterclockwise, and stops at a position in a state where the uppermost sheet P1 comes into contact with the roller member 162.

On the other hand, the lever 121 on the recording apparatus 10 side is held in press-contact with the cam gear 131 in the initial state by the lever spring 122. The sector gear holder 113, which moves in the arrow G direction, moves while abutting against a lower protruding portion 121*c* of the lever 121, and the second sector gear 112 pivots counterclockwise. Then, the second sector gear 112 meshes with the first sector gear 111, which has pivoted to a position at which the uppermost sheet P1 comes into contact with the roller member 162 and has stopped there.

The second sector gear 112 further pivots counterclockwise along with the movement of the sheet cassette 20 in the G direction, and the first sector gear 111, which is in mesh with the second sector gear 112, pivots clockwise. The pivoting of the first sector gear 111 causes the pressing plate 21 to move down against the urging force of the pressing plate spring 102. At this time, the pressing plate 21 is located at a position where to bring the uppermost sheet P1 into contact with the roller member 162.

The second sector gear 112, similarly to the sheet feeding operation, rotates by approximately the same rotational angle after starting to mesh with the first sector gear 111, and stops. As a result, regardless of the amount of stacking of the recording media P, the uppermost sheet P1 on the pressing plate can be spaced apart from the sheet feeding roller 41 by a given amount. With such a configuration, a clearance can be formed between the sheet feeding roller 41 and the uppermost sheet P1 of the recording media, so that the manual sheet feeding can be performed when mounting of the sheet cassette is completed.

Next, the manual sheet feeding operation will be described. In FIG. 6, a clearance is formed between the recording media P and the sheet feeding roller 41. When a recording medium P2 for manual sheet feeding is inserted from the manual feed port 200, the recording medium P2 is guided by a manual feeding guide 201, and is latched by a leading edge regulating member 203 (see FIG. 5) formed on the sheet cassette 20.

When a sheet feed command is issued in this state, similarly to the above-described sheet cassette, the motor (not illustrated) is driven, thereby rotating the cam 131*a* and the sheet feeding roller 41. The lever 121 rotates in the clockwise direction, the second sector gear 112 rotates in the clockwise direction, and the first sector gear 111 rotates in the counterclockwise direction. The pressing plate 21 pivots toward the sheet feeding roller 41 in conjunction with the first sector gear 111, thereby bringing the manually fed recording medium P2, placed on the recording media P stacked on the pressing plate 21, into press-contact with the sheet feeding roller 41, and then the recording medium P2 is fed. Subsequent operation is similar to sheet feeding from the sheet cassette described above.

In the process of mounting the sheet cassette in this manner, the pressing plate is caused to move in a direction of the sheet feeding roller, and when mounting of the sheet cassette is completed, a given clearance is formed between the uppermost sheet of the recording media and the sheet feeding roller. Consequently, when mounting of the sheet cassette is completed and afterward, the manual sheet feeding becomes possible. Further, by causing the pressing plate after the feeding operation to move by a given amount necessary for a clearance for the manual sheet feeding against a pressure-contacting force during the feeding operation regardless of the amount of stacking of the recording medium, and causing the recording medium to be spaced apart from the sheet feeding roller, an increase in drive load can be prevented.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-155677 filed Jun. 30, 2009, which is hereby incorporated by reference herein in its entirety.

The invention claimed is:

1. A feeding apparatus comprising:

a cassette configured to be mountable on an apparatus main body;

a pressing plate, provided on the cassette and movable up and down, configured to allow recording media to be stacked thereon;

a feeding roller configured to feed recording media stacked on the pressing plate;

a generating unit configured to contact a first part of the apparatus main body to generate an urging force in a process of mounting the cassette into the apparatus main body to cause the pressing plate to move in a first direction to come close to the feeding roller; and a moving unit configured to contact a second part of the apparatus main body to move the pressing plate moved by the generating unit in a second direction opposite to the first direction in a process of mounting the cassette into the apparatus main body.

2. The feeding apparatus according to claim 1, further comprising a regulation unit configured to regulate a position of the uppermost sheet of the recording media stacked on the pressing plate in the process of mounting the cassette.

3. The feeding apparatus according to claim 2, wherein the regulation unit includes a rotating member located above the recording media and rotatably mounted in a recording apparatus.

4. A recording apparatus comprising:

the feeding apparatus according to claim 1, configured to feed recording media to a conveying unit; and a recording unit configured to record recording information on a recording medium conveyed by the conveying unit.

5. The recording apparatus according to claim 4, wherein the recording unit is configured to perform recording on the recording medium by discharging ink from a nozzle.

6. The feeding apparatus according to claim 1, wherein the moving unit includes a first engagement member movable in operative association with the pressing plate and having a plurality of engagement portions along a movement direction thereof, and a second engagement member engageable with the first engagement member, and wherein the second engagement member and the second part engage with each other in the process of mounting the cassette, the first engagement member and the second engagement member engage with each other in a state where the second engagement member and the second part engage with each other, and the pressing plate moves by a predetermined amount in a direction to move away from the feeding roller in a state where the first and the second engagement members engage with each other.

7. The feeding apparatus according to claim 1, wherein the first part includes a guide surface configured to operate a spring included by the generating unit so that the spring generates the urging force in the process of mounting the cassette into the apparatus main body.

8. A feeding apparatus comprising:

a cassette configured to be mountable on an apparatus main body;

a pressing plate, provided on the cassette and movable up and down configured to allow recording media to be stacked thereon;

a feeding roller configured to feed recording media stacked on the pressing plate;

an urging unit configured to urge the pressing plate in a first direction to come close to the feeding roller in a process of mounting the cassette into the apparatus main body; and a moving unit configured to contact a part of the apparatus main body to move the pressing plate moved by the urging unit in a second direction opposite to the first direction in the process of mounting the cassette into the apparatus main body.

9. A recording apparatus comprising:

the feeding apparatus according to claim 8, configured to feed recording media to a conveying unit; and a recording unit configured to perform recording on a recording medium conveyed by the conveying unit.

10. The feeding apparatus according to claim 8, wherein the moving unit includes a first engagement member configured to move in engagement with the pressing plate, and a second engagement member configured to engage with the first engagement member in a state where an uppermost recording medium of the recording media stacked on the pressing plate is in contact with the feeding roller, and to move by a predetermined amount in a state engaging with the first engagement member to cause the pressing plate to move.

11. The feeding apparatus according to claim 10, wherein the first engagement member includes a first sector gear rotatable in operative association with the pressing plate, the second engagement member includes a second sector gear configured to be rotatable, the second sector gear meshes with the first sector gear in a state where the uppermost recording medium of recording media stacked on the pressing plate is in contact with the feeding roller, and the second sector gear rotates by a predetermined amount in a state where the second sector gear meshes with the first sector gear.

12. The feeding apparatus according to claim 11, wherein the second sector gear is rotated by a cam that rotates in synchronization with the feeding roller.

13. The feeding apparatus according to claim 12, wherein the moving unit causes the pressing plate to move so that a distance between the uppermost recording medium stacked on the pressing plate and the feeding roller becomes approximately constant with an error within two times a pitch length of the second sector gear regardless of the amount of recording media stacked on the pressing plate.

* * * * *